US006324809B1

(12) United States Patent
Nelson

(10) Patent No.: US 6,324,809 B1
(45) Date of Patent: Dec. 4, 2001

(54) ARTICLE WITH INTERLOCKING EDGES AND COVERING PRODUCT PREPARED THEREFROM

(75) Inventor: Thomas J. Nelson, Belton, TX (US)

(73) Assignee: Premark RWP Holdings, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/977,536

(22) Filed: Nov. 25, 1997

(51) Int. Cl.[7] ..... E04F 15/10
(52) U.S. Cl. ..... 52/592.2; 52/309.9; 52/309.14
(58) Field of Search ..... 52/589.1, 591.1, 52/591.3, 592.1, 592.2, 592.3, 592.4, 309.9, 309.14

(56) References Cited

U.S. PATENT DOCUMENTS

| | | | | |
|---|---|---|---|---|
| 2,142,305 | * | 1/1939 | Davis | 52/592.1 |
| 2,204,675 | | 6/1940 | Grunert | 20/8 |
| 2,430,200 | | 11/1947 | Wilson | 20/92 |
| 2,453,918 | | 11/1948 | Jansen | 20/92 |
| 2,740,167 | | 4/1956 | Rowley . | |
| 3,100,556 | | 8/1963 | De Ridder | 189/34 |
| 3,111,205 | | 11/1963 | Gresham | 189/34 |
| 3,128,851 | | 4/1964 | Deridder et al. | 189/34 |
| 3,182,769 | | 5/1965 | De Ridder | 189/36 |
| 3,310,919 | | 3/1967 | Bue et al. . | |
| 3,385,182 | | 5/1968 | Harvey | 94/13 |
| 3,526,420 | | 9/1970 | Brancaleone . | |
| 3,538,665 | | 11/1970 | Gohner . | |
| 3,590,545 | | 7/1971 | Webb | 52/588 |
| 3,657,852 | | 4/1972 | Worthington et al. . | |
| 3,694,983 | | 10/1972 | Couquet . | |
| 4,226,064 | | 10/1980 | Kraayenhof | 52/180 |
| 4,296,582 | | 10/1981 | Simpson et al. | 52/590 |
| 4,426,820 | | 1/1984 | Terbrack et al. | 52/594 |
| 4,449,346 | | 5/1984 | Tremblay . | |
| 4,461,131 | | 7/1984 | Pressell . | |
| 4,741,136 | | 5/1988 | Thompson | 52/302 |
| 4,769,963 | | 9/1988 | Meyerson . | |
| 4,845,907 | | 7/1989 | Meek | 52/177 |
| 4,905,442 | | 3/1990 | Daniels | 52/588 |
| 4,917,532 | | 4/1990 | Haberhauer et al. | 404/35 |
| 5,022,200 | | 6/1991 | Wilson et al. . | |
| 5,086,599 | | 2/1992 | Meyerson | 52/309.9 |
| 5,157,890 | | 10/1992 | Jines . | |
| 5,179,812 | | 1/1993 | Hill . | |
| 5,274,979 | | 1/1994 | Tsai | 52/595 |
| 5,295,341 | | 3/1994 | Kajiwara | 52/586.2 |

(List continued on next page.)

FOREIGN PATENT DOCUMENTS

| | | | | |
|---|---|---|---|---|
| 759196 | * | 5/1967 | (CA) | 52/592.2 |
| 200949 | | 1/1939 | (DE) . | |

(List continued on next page.)

*Primary Examiner*—Michael Safavi
(74) *Attorney, Agent, or Firm*—Aquilino, Welsh & Flaxman

(57) ABSTRACT

An article suitable for use in surface coverings such as laminate floorings, such articles having an upper planar decorative surface and a lower planar surface, and at least one male edge and at least one female edge. The male and female edges will interlock with corresponding female and male edges on a complimentary article. These male and female edges have profiles that provide the ability to interlock adjacent articles by approaching one article to the other at an angle, inserting the male edge into the female edge and causing the lower planar surfaces of the two articles to become coplanar, thus forming a gapless seam between the articles which can be formed, if desired, without glue and which can be, if desired, watertight.

11 Claims, 3 Drawing Sheets

U.S. PATENT DOCUMENTS

| | | | | |
|---|---|---|---|---|
| 5,349,796 | * | 9/1994 | Meyerson | 52/589.1 |
| 5,497,589 | * | 3/1996 | Porter | 52/592.1 |
| 5,622,012 | * | 4/1997 | Schijf | 52/592.2 |
| 5,706,621 | | 1/1998 | Pervan . | |
| 5,736,227 | | 4/1998 | Sweet et al. . | |
| 5,860,266 | | 1/1999 | Martinet et al. . | |
| 6,006,486 | | 12/1999 | Moriau et al. | 52/589.1 |

FOREIGN PATENT DOCUMENTS

| | | | | |
|---|---|---|---|---|
| 2159042 | * | 6/1973 | (DE) | 52/592.2 |
| 1 534 278 | | 12/1973 | (DE) . | |
| 1534278 | | 12/1973 | (DE) . | |
| 2502992 | | 1/1975 | (DE) . | |
| 26 16 077 A1 | | 4/1976 | (DE) . | |
| 3544845 A1 | | 12/1985 | (DE) . | |
| 4242 530 A1 | | 6/1994 | (DE) . | |
| 4242530A1 | | 6/1994 | (DE) . | |
| 558767-A1 | | 9/1993 | (EP) . | |
| 1293043 | | 4/1962 | (FR) . | |
| 2108402 | | 5/1972 | (FR) . | |
| 2 568 295 | | 1/1986 | (FR) . | |
| 424057 | | 7/1934 | (GB) . | |
| 1275511 | | 5/1972 | (GB) . | |
| 1 430 423 | | 5/1973 | (GB) . | |
| 1430423 | | 5/1973 | (GB) . | |
| 2117813 (A) | | 3/1983 | (GB) . | |
| 2126106A | | 3/1984 | (GB) . | |
| 2256023 (a) | | 5/1991 | (GB) . | |
| 57-119056 | | 7/1982 | (JP) . | |
| 3-169967 | | 7/1991 | (JP) . | |
| 157871 | | 12/1983 | (NO) . | |
| 7114900-9 | | 5/1973 | (SE) . | |
| 8206934-5 | | 6/1984 | (SE) . | |
| WO 84/02155 | | 6/1984 | (WO) . | |
| WO 93/13280 | | 7/1993 | (WO) . | |
| WO 94/04773 | | 3/1994 | (WO) . | |
| WO 94/26999 | | 11/1994 | (WO) . | |
| WO 97/47834 | | 12/1997 | (WO) . | |

* cited by examiner

ARTICLE WITH INTERLOCKING EDGES AND COVERING PRODUCT PREPARED THEREFROM

BACKGROUND OF THE INVENTION

1. Field of the Invention

The present invention relates to an article having interlocking edges and its use in preparing a covering product useful for covering flat surfaces as well as rounded surfaces, particularly useful in preparing a laminate flooring product that is easy to install, easy to repair, essentially glueless in installation and essentially waterproof in use due to the profile and composition of its interlocking edges.

2. Discussion of the Background:

In recent years the use of laminate products in the flooring industry as a replacement or substitute for traditional wood plank flooring has grown tremendously due to the durability and ease of care of the laminate products. However, the laminate flooring products currently available often have several disadvantages.

Many conventional laminate floor products have edges that are machined to fit one into the other. However, the conventional method for preparing such edges provides an interference fit (shown in FIG. 1). In the interference fit type of edge, any glue that is placed in the cutout portion of the edge must be forced out upon insertion of the corresponding edge on an adjacent piece of laminate. Due to the tight fit, however, the fitting together of the laminate pieces often requires pressure and clamps to hold the pieces together. Additionally when the pieces are joined, and the glue is forced out of the cutout edge, there is no way to control the direction in which the glue will exit. It can exit either in an upwards direction towards the visible surface of the flooring or in a downwards direction to the surface adjacent the subflooring. Either of these options can be detrimental to both the appearance and function of the resulting floor.

In U.S. Pat. No. 5,618,602, an improved laminate floor was provided in which the rib and cutout edges of the laminate floor sections are machined in such a manner as to provide an escape path for glue from the cutout edge up to the visible floor surface while maintaining sufficient glue on the edge surface to bond the adjacent sections together.

However, since essentially no glue is allowed to exit from the bottom of the laminate flooring, the resulting floor can encounter problems due to entry of water into the seam formed by the edges from below. Since the substrate for the laminate flooring described therein is fiberboard based (wood based), the entry of water can cause swelling, ultimately resulting in buckling or other distortions in the floor.

Additionally, most laminate flooring requires the use of glue applied at the interface of each flooring section, and for direct gluedown applications glue is placed on the bottom surface of the flooring section to adhere it to the underfloor. Once the glue sets, the resulting floor can be extremely difficult to repair or replace. Additionally, due to expansion and/or contraction within individual sections of laminate flooring, the resulting floor can undergo various stresses causing distortions, buckling, etc., thus marring the appearance of the floor.

A new type of surface covering edge design, particularly in the laminate flooring arena, is needed to overcome these disadvantages.

SUMMARY OF THE INVENTION

Accordingly, one object of the present invention is to provide a new surface covering product that is easy to install, can be installed without glue if desired, is easy to repair and/or replace and is essentially waterproof A further object of the present invention is to provide a new surface covering product having an edge design that can be assembled and disassembled in a simple manner without tools or glue.

Another object of the present invention is to provide a surface covering product that has a substantially hydrophobic interior to provide a watertight seam between sections.

Another object of the present invention is to provide a laminate flooring prepared from the surface covering product of the present invention.

Another object of the present invention is to provide a surface covering product that can be used as flooring, wall covering, ceilings and on curved surfaces.

These and other objects of the present invention have been satisfied by the discovery of an article that is suitable for use in surface coverings such as laminate floorings, wherein the article has a planar decorative surface, a lower planar surface and at least one male edge and at least one female edge, with the male and female edges having profiles that provide the ability to interlock adjacent articles by approaching one article to the other at an angle, inserting the male edge into the female edge and causing the lower planar surfaces of the two articles to become coplanar, thus forming a gapless seam between the articles which can be formed, if desired, without glue and which can be, if desired, watertight.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
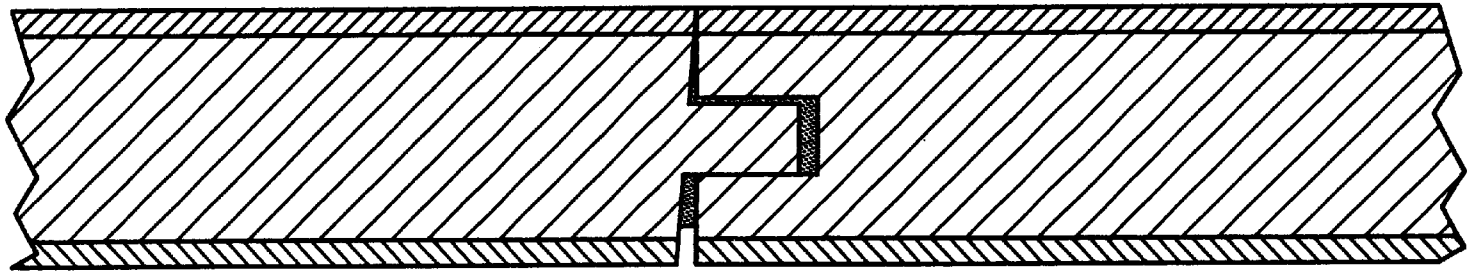
FIG. 1 shows a conventional forced fit edge in a laminate product.
Figure 2:
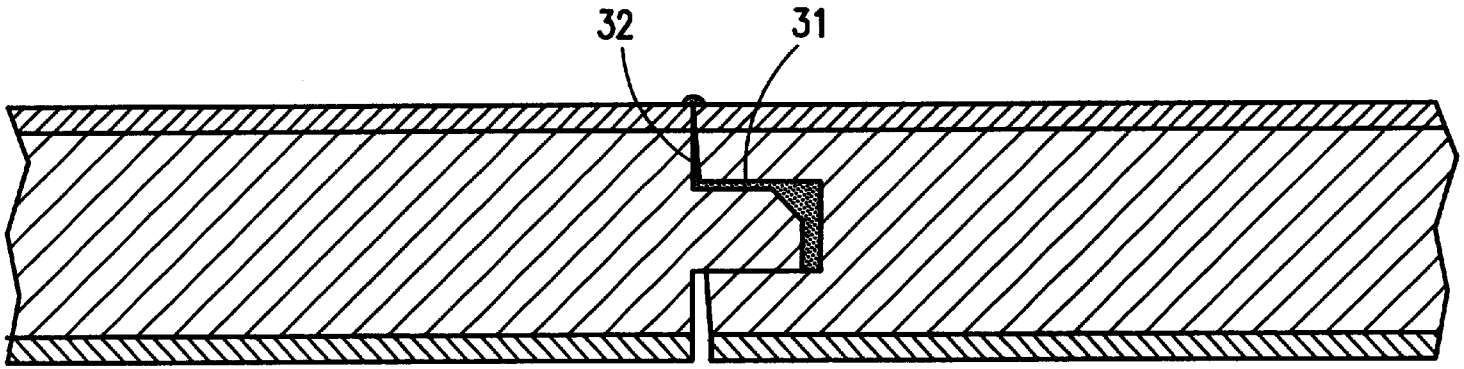
FIG. 2 shows a laminate flooring edge in accordance with U.S. Pat. No. 5,618,602.

The article of the present invention comprises a central core having an upper surface and lower surface and a plurality of edge surfaces around its periphery. The upper surface and lower surface can be, independently, selected from the upper and lower surfaces of the central core, respectively; a decorative layer, such as a high pressure decorative laminate, a solid surfacing veneer or solid surfacing laminate (such as that described in U.S. application Ser. No. 08/899,118); or any other conventional decorative layer that can be bonded to the central core. Preferably, the upper and lower surfaces are each a decorative layer, respectively, most preferably a high pressure decorative laminate layer. The upper and lower decorative layers may be the same or different. The decorative layers can be formed from a variety of materials. Suitable materials for the decorative layers include, but are not limited to, conventional high pressure decorative laminate (made from melamine formaldehyde impregnated kraft paper layers), wood veneers or conventional polymeric solid surfacing veneers or laminates. The decorative layers can be attached to the core using conventional means, such as adhesives, or by coextrusion of the core and decorative layers, either with or without a tie layer.

When the core forms the entire article, the core can be prepared from wood, wood based products such as fiberboard (such as high density fiberboard), polymeric materials etc. Suitable polymeric materials include, but are not limited to, rigid thermoplastics and thermosets, as well as more flexible elastomers and rubbers. When the article of the present invention is to be used to form a surface covering for a curved surface (either concave or convex), the article is preferably made from one of these more flexible materials in order to conform to the curved surface, particularly when the surface is convex. The preferred design of the male and female edges of the present article allow for significant rotation when the surface covering formed therefrom is used on a concave curved surface. However, if the article is formed of a rigid wood or polymer product (either solid, foamed or laminate), the resulting surface covering has little or no flexibility when placed on a convex surface.

The core of the present product can be formed from a variety of materials, such as wood or wood based products, plastics, metals, etc. In order to gain the maximum in waterproofing and dimensional stability over time, it is preferred to make the central core from a plastic, more preferably from a hydrophobic polymer. Suitable hydrophobic polymers include polyvinyl chloride, polystyrene, polyolefins, etc. The core is most preferably prepared from a foamed hydrophobic polymer, such as an ABS, HIPS or polyvinyl chloride foam having a preferred density reduction of from 0 to 50%, more preferably from 20 to 40% density reduction, most preferably about 30% density reduction. Within the context of the present invention, the term "density reduction" is defined as the percentage by which the density of the foam is lower than the density of the unfoamed polymer that comprises the foam. The use of the hydrophobic polymer foam of the present invention provides both improved watertight seam properties as well as ease of handling due to the lighter weight of the foam.

The core can be formed by any conventional process, including but not limited to, molding, casting, extrusion, etc. when the core is made of a polymeric material. When the core is made from a fiberboard composition, the core can be prepared by any conventional process. When the article is a solid piece of wood, the article can be prepared by conventional woodworking techniques, so long as the edge profile is prepared to meet the requirements of the invention. The profile of the edges of the laminate flooring of the present invention can be formed by routing, cutting, etc as needed. Further, when the core is made from a polymeric material, the profile of the edges can be made by cutting or can be formed by extruding the core with the profiles intact.

The article of the present invention has an upper surface and a lower surface, with at least one male edge and at least one female edge, wherein the at least one male edge and the at least one female edge are located on opposing sides from one another. The edges are formed to provide a profile such that two pieces of the article can be joined together along the male and female edges of the adjacent pieces as shown in FIG. 3A, by approaching one piece of the article with a second piece of the article from an angle, $\alpha$, as shown in FIG. 3B.

Figures 3A, 3B, 3C:
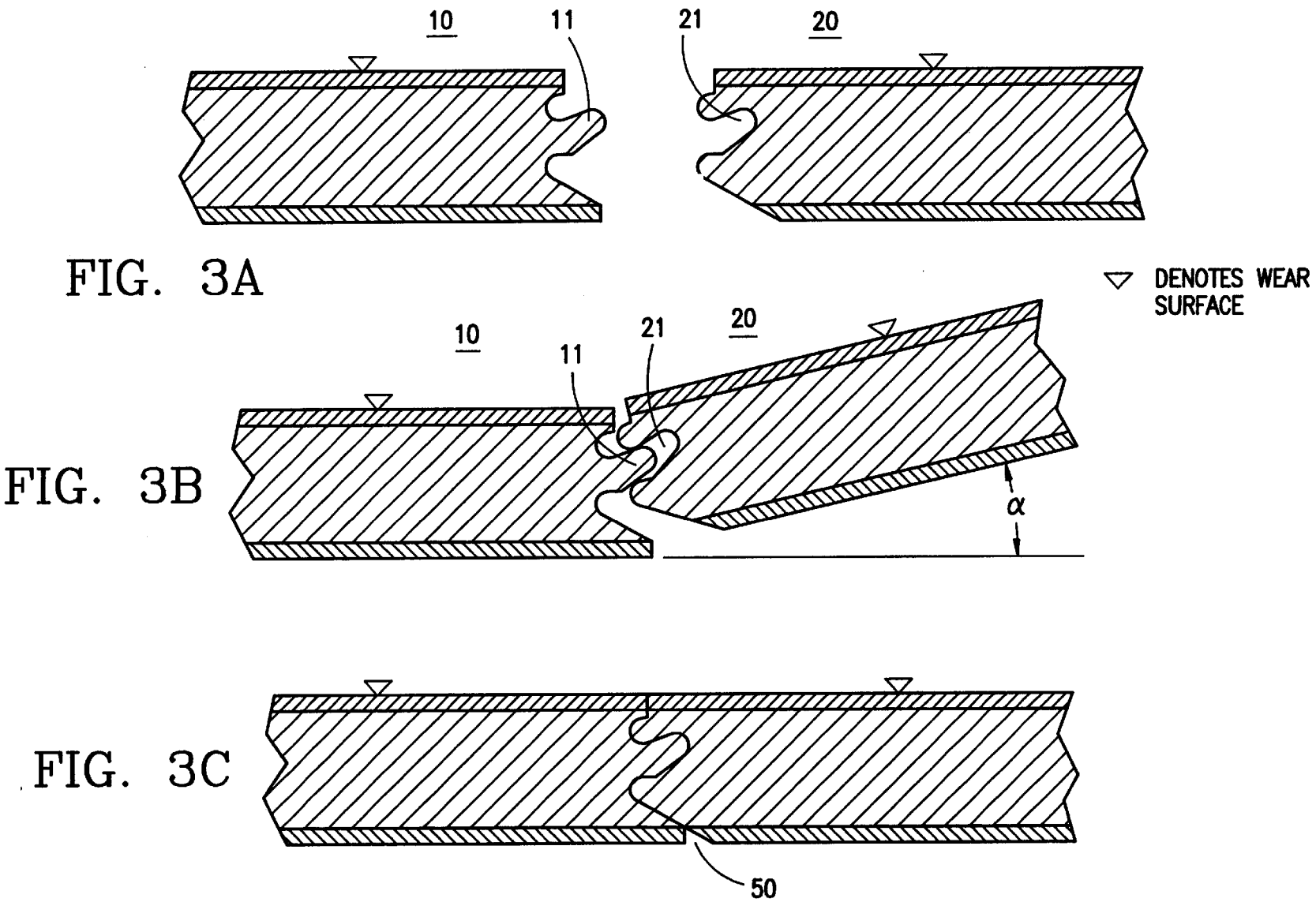
FIG. 3A–3C show a preferred embodiment of a surface covering formed from an article of the present invention, namely a laminate flooring of the present invention and the manner in which the articles of the present invention can be joined.

Referring to FIG. 3A and FIG. 3B, male edge containing piece, 10, has rib 11 that inserts into a corresponding groove 21 in female edge containing piece, 20. Once rib 11 is seated in the corresponding groove 21 of female edge containing piece 20, the female edge containing piece 20 is lowered such that the upper surfaces of the two article pieces become coplanar and the lower surfaces of the two article pieces become coplanar also. The edge profile of each piece is formed in a pattern such that upon reaching the final coplanar arrangement, the male edge and female edge of the two pieces form a gapless seam that interlocks, as shown in FIG. 3C. The interlocking is sufficient to prevent separation of the two article pieces upon application of force on either or both article pieces along a vector parallel to the upper or lower surfaces.

The edge profiles are formed in order to provide an approach angle $\alpha$ of from 10 to 45 degrees, preferably from 10 to 20 degrees, most preferably 15–18 degrees.

While the edge profiles do not separate by pulling the two pieces in opposite directions (without breaking either the male edge or female edge profile), in a preferred embodiment, the edge profile is shaped such that the two pieces can also be joined together by aligning the two pieces such that the upper surfaces are coplanar and the lower surfaces are coplanar and pushing the two pieces together to snap the male and female edges into place and form the gapless seam. Even this embodiment, however, cannot be pulled apart by pulling the pieces in opposite directions without breakage of the male or female edge due to the interlocking nature of the edge profiles.

Figure 4:
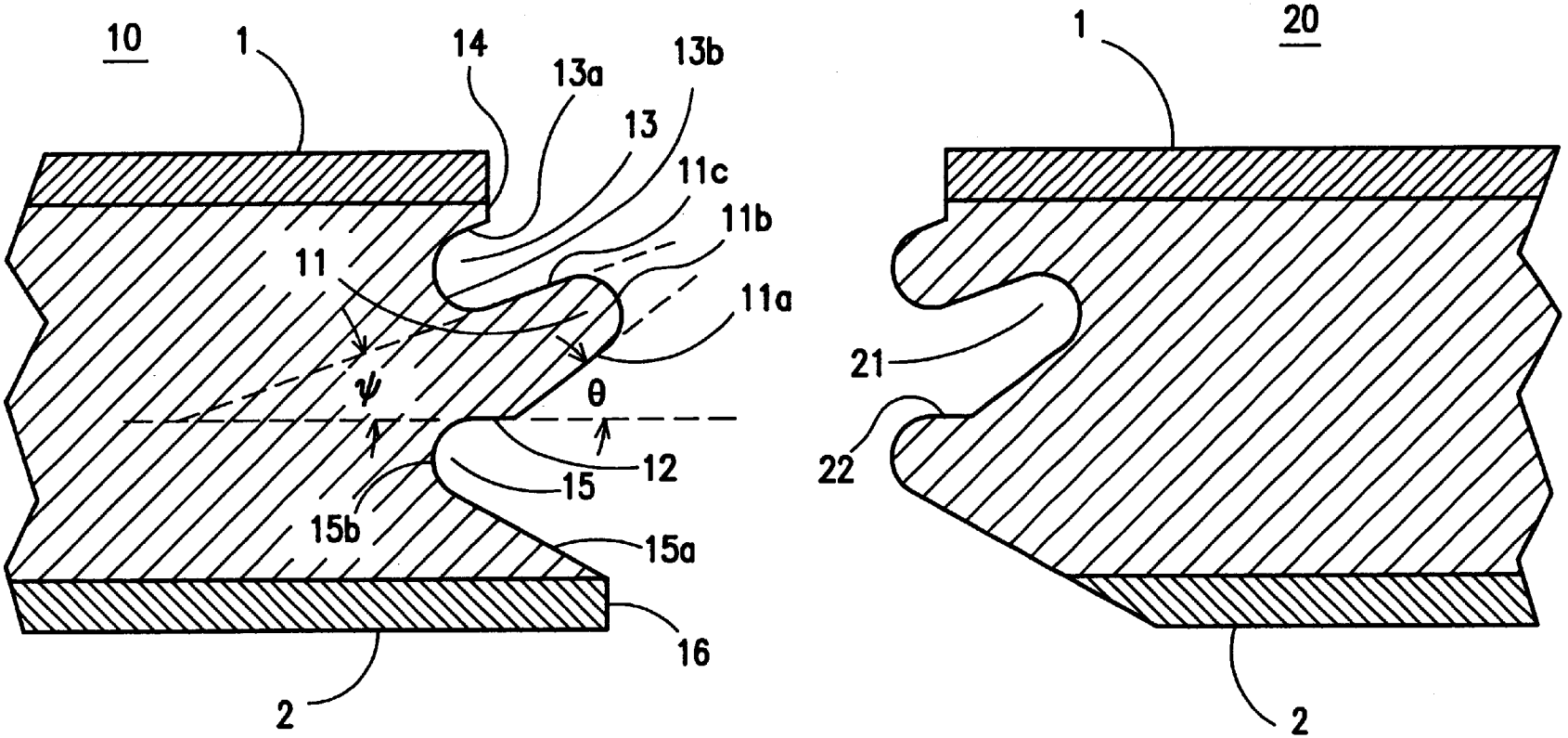
FIG. 4 shows an enlarged portion of a preferred edge design according to the present invention.

A most preferred embodiment of the present invention is shown in FIG. 4, which shows two adjacent sections of a laminate flooring product of the present invention, each having a planar decorative surface 1 and a lower planar surface 2, with one piece bearing a male edge 10 and the adjacent piece bearing a female edge 20. The male edge 10 and female edge 20 each have a planar index surface 12 and 22 respectively. The two planar index surfaces 12 and 22 are each the same distance from the planar decorative surface 1.

The remaining description of the edge profile will center on the male edge of the preferred embodiment, with the understanding that the female edge is designed to provide the ease of construction qualities of the present invention and to be at least nearly completely exactly complementary to the male edge profile. Within the context of the present invention, the term "nearly completely" indicates that the lower surfaces of the male and female edges may not form a completely gapless seam, as shown in the gap 50 of FIG. 3C. This gap does not have to be present but is preferred in order to allow for wear in the cutting tools used to form the edge profile, which would otherwise cause a perfectly fitting seam to gradually force the lower planar surfaces away from coplanar. With the small gap 50 in the bottom of the edge, the cutters can last longer between changes without detrimentally affecting the fit of the seam.

In the most preferred embodiment of FIG. 4, the male edge 10 has a rib 11 above the planar index surface 12. Between rib 11 and planar decorative surface 1 is a groove 13. Rib 11 is angled from planar index surface 12 towards the plane formed by planar decorative surface 1 such that a first lower surface 11*a* of rib 11 forms an angle $\theta$ with the planar index surface 12. Angle $\theta$ can be from 20 to 50 degrees, preferably from 25 to 45 degrees, most preferably from 30 to 40 degrees. Rib 11 has a rounded distal end 11*b* and a first upper surface 11*c* of the rib that is non-parallel with first lower surface 11*a* of rib 11, such that first upper surface 11*c* of rib 11 forms an angle $\psi$ with the plane formed by planar index surface 12. Accordingly, $\psi<\theta$.

First upper surface 11*c* of rib 11 also forms a second lower surface 11*c* of the first groove 13. First groove 13 has a second upper surface 13*a* that is joined to the second lower surface 11*c* by a first rounded cutout 13*b*. Second upper surface 13*a* extends from first rounded cutout 13*b* to a top edge surface 14. Top edge surface 14 extends from the second upper surface 13*a* of first groove 13 to meet planar decorative surface 1.

Below the planar index line 12 in the male edge is a second groove 15 having a third upper surface that corresponds to planar index line 12. The third upper surface (planar index line 12) is coupled to a third lower surface 15*a* by way of second rounded cutout 15*b*. Third lower surface 15*a* extends to meet a lower edge surface 16 which extends from third lower surface 15*a* to lower planar surface 2.

The female edge 20 has a profile that is complementary to the male edge to the extent that upon joining an article having a male edge with an article having a female edge, a seam is formed that is without gaps from at least a point below and adjacent the planar decorative surface 1 (corresponding to the intersection of upper edge surface 14 and second upper surface 13*a* of first groove 13) to at least a point above and adjacent lower planar surface 2 (corresponding to the intersection of third lower surface 15*a* of second groove 15 and the lower edge surface 16).

In a further preferred embodiment, it is possible to bevel the planar decorative surface of each of the male and female edges to provide an angled surface down to the point where the planar decorative surface meets the central core. This would provide a grooved or notched seam upon joining adjacent sections for further decorative effect in a surface covering product, particularly in a laminate flooring.

Obviously, additional modifications and variations of the present invention are possible in light of the above teachings. It is therefore to be understood that within the scope of the appended claims, the invention may be practiced otherwise than as specifically described herein.

What is claimed is:

1. An article comprising an upper planar surface, a lower planar surface, at least one male edge and at least one female edge;

wherein each of the at least one male edge and at least one female edge have a planar index surface located at a set identical distance from the upper planar surface;

wherein said at least one male edge has a rib above said planar index surface, with a first groove above said planar index surface between said rib and said upper planar surface, wherein said rib is angled from said planar index surface towards a first plane formed by said upper planar surface, such that a first lower surface of said rib forms an angle $\theta$ with a second plane formed by said planar index surface, said rib having a rounded distal end and a first upper surface extending from said rounded distal end towards said second plane, such that a line extending along said first upper surface intersects said second plane at an angle $\psi$, wherein $\psi<\theta$;

said first upper surface of said rib also forming a second lower surface of said first groove, said first groove having a second upper surface joined to said second lower surface by a first rounded cutout portion and extending to meet a top edge surface, wherein the top edge surface extends to meet said upper planar surface;

wherein said at least one male edge has a second groove below said planar index surface, wherein said second groove has a third upper surface formed by said planar index surface and coupled to a third lower surface by a second rounded cutout portion, wherein said third lower surface extends to meet a lower edge surface, said lower edge surface meeting with said lower planar surface;

and wherein said at least one female edge has a profile that is complementary to said at least one male edge such that upon joining two of the articles together, a seam made at an interface of said male edge of one article and said female edge of another article is without gaps from at least a point below and adjacent said upper planar surface to at least a point above and adjacent said lower planar surface.

2. The article of claim 1, wherein said upper planar surface and said lower planar surface are formed by laminating a surfacing material onto a central core and said at least one male edge and said at least one female edge are located at exposed edges of said central core.

3. The article of claim 2, wherein said central core is made of a material selected from the group consisting of fiberboard, solid polymeric materials and foamed polymeric materials.

4. The article of claim 2, wherein said central core is made of a material selected from the group consisting of hydrophobic polymers.

5. The article of claim 2, wherein said upper planar surface and said lower planar surface are each, independently, selected from the group consisting of high pressure decorative laminates and polymeric surfacing materials.

6. The article of claim 2, wherein each of said upper planar surface and said lower planar surface are a high pressure decorative laminate and said central core is a foamed polymeric material, wherein said upper planar surface and said lower planar surface can be the same or different.

7. The article of claim 6, wherein said foamed polymeric material is a foamed polyvinyl chloride, polyacrylonitrile-co-butadiene-co-styrene (ABS), polyamide or high impact polystyrene (HIPS).

8. The article of claim 7, wherein said foamed polyvinyl chloride has a density reduction of from 0 to 50%.

9. The article of claim 1, wherein said upper edge surface is perpendicular to said upper planar surface.

10. The article of claim 1, wherein said lower edge surface is perpendicular to said lower planar surface.

11. The article of claim 9, wherein a portion of said female edge, corresponding in location to said lower edge surface of said male edge, forms an obtuse angle with the lower planar surface.

* * * * *